US005792289A

United States Patent [19]

Morton et al.

[11] Patent Number: 5,792,289

[45] Date of Patent: Aug. 11, 1998

[54] TITANIUM ALLOY PRODUCTS AND METHODS FOR THEIR PRODUCTION

[75] Inventors: Peter Harlow Morton, West Midlands; Andrew Bloyce, Worcester; Hanshan Dong, Birmingham, all of Great Britain

[73] Assignee: The University of Birmingham, Bimingham, Great Britain

[21] Appl. No.: 624,515

[22] PCT Filed: Oct. 4, 1994

[86] PCT No.: PCT/GB94/02149

§ 371 Date: Jun. 28, 1996

§ 102(e) Date: Jun. 28, 1996

[87] PCT Pub. No.: WO95/09932

PCT Pub. Date: Apr. 13, 1995

[30] Foreign Application Priority Data

Oct. 6, 1993 [GB] United Kingdom ..... 9320528
Mar. 31, 1994 [GB] United Kingdom ..... 9406435

[51] Int. Cl.[6] ..... C22C 14/00

[52] U.S. Cl. ..... 148/421; 148/237; 148/512

[58] Field of Search ..... 148/237, 512, 148/421

[56] References Cited

U.S. PATENT DOCUMENTS

| | | | |
|---|---|---|---|
| 4,902,359 | 2/1990 | Takeuche et al. | 148/512 |
| 5,139,585 | 8/1992 | Watanabe et al. | 148/512 |
| 5,466,305 | 11/1995 | Sato et al. | 148/237 |
| 5,525,165 | 6/1996 | Wu et al. | 148/237 |
| 5,573,604 | 11/1996 | Gerdes et al. | 148/237 |

FOREIGN PATENT DOCUMENTS

| | | |
|---|---|---|
| 0246828 | 11/1987 | European Pat. Off. . |
| 2257163 | 1/1993 | United Kingdom . |
| WO86/02868 | 5/1986 | WIPO . |
| WO91/05072 | 4/1991 | WIPO . |

OTHER PUBLICATIONS

Strength of Metals and Alloys, "Rapid Solidfication and Aging of a . . . ", Baeslack III et al, pp. 1633–1638, Aug. 1985.

Rapid Solidification Studies in Eutectoid . . . , L.S. Chumbley et al, Department of Materials Science. Mar. 1986.

Patent Abstracts of Japan, vol. 6, No. 24, Feb. 12, 1982.

Patent Abstracts of Japan, vol. 11, No. 39, Feb. 5, 1987.

Patent Abstracts of Japan, vol. 11, No. 251, Aug. 14, 1987.

2010 Le Vide, Les Couches Minces 43, "Traitments De Surface Par Laser", G. Coquerelle, pp. 545–563, 1988.

*Primary Examiner*—John Sheehan

*Attorney, Agent, or Firm*—Jacobson, Price, Holman & Stern, PLLC

[57] ABSTRACT

A titanium alloy product having good tribological properties without the need to introduce an alloying element into the surface is produced by casting or casting and forging a titanium alloy consisting of 2 to 15% by weight silicon or 5 to 15% by weight nickel, 0 to 7% by weight of at least one strengthening element selected from aluminum, tin, zirconium, chromium, manganese, iron, molybdenum and niobium, and 0 to 2% by weight of a surface improving alloying element selected from boron, carbon, nitrogen, oxygen, and zirconium, the balance apart from impurities and incidental ingredients being titanium. Such alloy is then surface treated by surface melting and rapid solidification so as to produce a hard, wear-resistant surface layer without substantially affecting the bulk properties of the alloy. In another aspect, titanium alloy product which is resistant to both to rolling contact fatigue and to scuffing comprises casting or casting and forging a titanium alloy which is preferably of the above type, to the required product shape, deep surface hardening the resultant shaped product to a depth greater than 100 μm by localized re-melting without further alloying, optionally surface finishing (e.g., by machining, grinding, heat-treating or shot peening to the required final shape and/or surface finish, and forming on the intermediate surface a nitride or oxide or other surface film having a thickness which is not greater than 100 μm and which is resistant to scuffing.

14 Claims, 3 Drawing Sheets

| Sample No. | 11 | 12 | 13 | 14 | 15 | 16 |
|---|---|---|---|---|---|---|
| Materials | Ti6A14V | Ti-8.5Si | Ti-8.5Si | Ti-8.5Si | Ti-8.5Si | Ti-8.5Si |
| Treatments | Untreated | Untreated | EBSM | PN | EB+PN | EB+TO |

| Sample No. | 11 | 12 | 13 | 14 | 15 | 16 |
|---|---|---|---|---|---|---|
| Materials | Ti6A14V | Ti-8.5Si | Ti-8.5Si | Ti-8.5Si | Ti-8.5Si | Ti-8.5Si |
| Treatments | Untreated | Untreated | EBSM | PN | EB+PN | EB+TO |

TITANIUM ALLOY PRODUCTS AND METHODS FOR THEIR PRODUCTION

This invention relates to titanium alloy products and methods for their production, and in particular relates to such products which are required to have good tribological properties.

Although titanium is strong and light, applications of titanium in general engineering are limited by its poor tribological properties. It has been proposed in, for example, WO 91/05072, EP-A-0246828, WO 86/02868 and Metal Science and Heat Treatment, vol 26, no. 5/6, May-June 1984, pages 335 and 336, to improve the tribological properties of titanium and titanium alloys by melting suitable alloying ingredients such as boron, carbon, nitrogen, oxygen, silicon, chromium, manganese, iron, cobalt, nickel, copper into a surface layer using localised high energy surface melting techniques such as laser beam melting or electron beam melting. However, it is difficult to ensure that the required alloying ingredients are introduced evenly and in the correct quantity into the melted surface layer. Additionally, it is difficult in a non-destructive test to check that the surface layer in the final product has the correct distribution and composition.

It is an object of a first aspect of the present invention to obviate or mitigate the above disadvantage.

According to said one aspect of the present invention, there is provided a method of forming an titanium alloy product having a hardened layer thereon, comprising the steps of:

(1) forming the product (preferably by a casting operation and more preferably by a casting and forging operation) from a titanium alloy consisting of (a) 2 to 15% (preferably 5 to 9%) by weight silicon or 5 to 15% (preferably 8 to 11%) by weight nickel, (b) 0 to 7% by weight of at least one of the alloying elements conventionally used to strengthen wrought titanium alloys (aluminium, tin, zirconium, vanadium, chromium, manganese, iron, molybdenum and niobium) and (c) 0 to 2% by weight of at least one alloying element added specifically for the purpose of improving the surface properties and selected from boron, carbon, nitrogen, oxygen and zirconium, the balance apart from impurities and incidental ingredients being titanium, and (2) surface treating the product by a surface melting and rapid solidification operation so as to produce a hard wear-resistant surface layer without substantially affecting the bulk properties of the alloy.

It has now been found that contrary to previous expectation, the titanium-silicon alloy is quite easily forged at 1000° C. and so can be made by casting and forging route, rather than having to cast it to shape. The use of a forging operation enables the structure of the alloy to be refined to permit an improvement in ductility of the bulk material (i.e., the core or substrate of the product as opposed to the surface case) by a sequence of working and heat treatment operations to produce a wrought product. A typical sequence of such operations for an alloy containing 8.5 wt % silicon would comprise casting an ingot, forging it at 1000° C. so as to produce an appropriately shaped billet or preform, annealing it at 550 to 750° C., precision die forging it at 1000° C. to the required shaped component and machining it to approximate final dimensions.

The surface treatment step (2) gives rise to a microstructural change during rapid cooling which results in a fine-grained surface layer consisting predominantly of Ti-Si or Ti-Ni eutectic which is substantially harder than the substrate.

It will thus be appreciated that there is no need to make specific additions to the surface and that surface hardening takes place automatically upon surface melting as a direct result of the alloy material chosen.

With regard to the optional strengthening alloying elements and optional surface-improving elements, it will be noted that zirconium can be used both for strengthening and for surface-improving. In the case where it is included for both purposes, it will normally be present in an amount of up to 7% by weight.

Also according to said first aspect of the present invention, there is provided a titanium alloy product, (preferably a cast or wrought titanium alloy product), formed of a titanium alloy consisting of (a) 2 to 15% (preferably 5 to 9%) by weight silicon or 5 to 15% (preferably 8 to 11%) by weight nickel, (b) 0 to 7% by weight of at least one alloying element selected from aluminium, tin, zirconium, vanadium, chromium, manganese, iron, molybdenum and niobium, and (c) 0 to 2% by weight of at least one further element selected from boron, carbon, nitrogen, oxygen and zirconium, the balance apart from impurities and incidental ingredients being titanium, the titanium in the bulk of the product being present predominantly in the $\alpha$ phase, and said product having a layer thereon containing fine grained Ti-Si or Ti-Ni eutectic.

In the case of Ti-Si, the eutectic is a $Ti/Ti_5Si_3$ eutectic. In the case of Ti-Ni, the eutectic is a $Ti/Ti_2Ni$ eutectic.

It has been proposed by Mazur, V. I. et al, "Cast and "Sintered Ti-Si Alloys", and by Bankovsky O. I. et al "Mechanical Properties of Ti-Si Cermets", pages 141–146 and 435–440 of Proceedings of International Conference on "Processing and Properties of Materials", Birmingham, UK, September 1992 (Ed. M H Loretto), provide titanium alloys having improved mechanical properties such as high-temperature-strength and heat-resistance using powder metallurgy techniques where droplets of titanium-silicon alloy are formed and rapidly cooled to form granules or grains which are then hot isostatically pressed to form high strength materials. However, such forming techniques are relatively complicated and expensive and do not involve localised surface re-melting as in the present invention to develop a hardened layer whilst retaining a relatively tough core or substrate.

Where silicon is used in the alloy, the silicon content of the alloy is preferably 7.5 to 8.5%, and most preferably is 8.5% by weight.

In a second aspect of the present invention, it is an object to improve the tribological properties of titanium alloy in terms of both rolling contact fatigue resistance and resistance to scuffing. This is particularly important for products such as gears or bearings where the surface is subjected to high contact loads and Hertzian stresses are generated below the surface which reach a maximum distance below the surface. To withstand these stresses, it is generally accepted that a metallic material needs to be case hardened to a depth of about twice the depth of maximum shear stress. In practice, this means case depths of 200 to 1000 μm. It is generally accepted that such depth of hardening cannot be achieved in titanium alloys except by molten phase surface alloying. One proposed way of effecting this is by so-called "laser gas nitriding" which is a surface alloying process in which nitrogen is added to the molten pool during laser beam melting of the surface. It is also known from EP-A-0246828 to melt-harden the surface of a titanium alloy by spraying the surface with a plasma jet containing, as a working gas, a mixture of an inert gas and a hardening gas formed of one or more gases selected from nitrogen, carbon dioxide, carbon monoxide, oxygen, methane and ammonia, thereby melting the surface and alloying it with nitrogen, carbon, oxygen or hydrogen. In both of these methods, an alloying addition is made to the surface material in order to harden it.

In accordance with said second aspect of the present invention, there is provided a method of forming a titanium alloy product which is resistant both to rolling contact fatigue and to scuffing, comprising the steps of:

(a) forming a titanium alloy to the required product shape (preferably by a casting or a casting and forging operation), (b) deep surface hardening the resultant shaped product to a depth greater than 100 μm by a technique involving localised surface re-melting without further alloying, (c) optionally surface finishing (eg by machining or grinding) to the required final shape and surface finish, (d) forming on the immediate surface a nitride or oxide or other surface film having a thickness which is not greater than 100 μm (and usually not greater than 50 μm) and which is resistant to scuffing, and (e) optionally performing a procedure such as shot peening or heat treatment after any of steps (b), (c) and (d) in order to modify the residual stresses in the material and/or its other mechanical properties.

The deep surface hardening step (b) may be conducted simply by localised surface re-melting, e.g., by laser beam or electron beam, if the titanium alloy used is a titanium-silicon or titanium-nickel alloy of the type used in the first aspect of the present invention. This provides a surface resistant to deformation under high contact stresses. The titanium nitride or other surface film applied in step (d) provides a lower friction surface which is resistant to sliding wear and scuffing. The combination of steps (b) and (d) provides an ideal surface to resist the effect of combined rolling and sliding such as is typically encountered in gears and bearings.

EP-A-0246828 referred to above also discloses a process where a titanium alloy is subjected to molten phase surface alloying by use of one or more hardening alloy elements selected from aluminium, tin, boron, iron, chromium, nickel, manganese, copper, silicon, silver, tungsten, molybdenum, vanadium, niobium, columbium, tantalum and zirconium which are included in the molten surface pool, whilst at the same time spraying the surface pool with a hardening gas such as nitrogen with the specific objective of obtaining deep penetration of such hardening gas into the molten surface layer with the intention that the final surface layer contains the hardening alloy element or elements and the hardening gas or gases. The resultant final surface layer consists of a mixture of metallic phases (α and β titanium solid solutions) and intermetallic or compound phases (such as $Ti_2Ni$, TiN etc). Whilst EP-A-0246828 does not specifically describe any machining or grinding subsequent to melt hardening, it may be inferred from the reference therein to the preparation of wear-resistant components such as poppet valves that some finishing operation is needed in order to obtain the dimensional accuracy necessary for such components, for example on the seating face of a valve. EP-A-0246828 does not however disclose any further surface treatment after final machining or grinding. By contrast, in the second aspect of the present invention, step (d) is performed after any final machining or grinding (step (c)), in order to provide resistance to scuffing.

The thickness of the intermediate deep-hardened layer is preferably 200 to 1000 μm, whilst the thickness of the nitride, oxide or other surface film is preferably no more than 100 μm, more preferably no more than 50 μm, and most preferably 1 to 20 μm.

Formation of the nitride or oxide or other surface film in step d) of the process may be effected by a variety of means. One preferred method is the plasma thermochemical reaction process known as plasma nitriding in which the component is reacted with nitrogen in a low discharge plasma in order to form layers of nitride and nitrogen-rich titanium on the surface. Another preferred process is thermal oxidation in which the component is heated in air at 600° to 850° C. to produce layers of oxide and oxygen-rich titanium on the surface. However it is also within the scope of the present invention to deposit a discrete compound layer on the surface, for example by Physical Vapour Deposition. Such a compound layer may be titanium nitride or it may be aluminium nitride or titanium-aluminium nitride or chromium nitride or alternatively a film of oxide, carbide or boride.

The surface finish resulting from the surface re-melting operation is generally inadequate for use in a wear-resistant application and a component will normally be given a surface finishing treatment such as machining or grinding to produce a smooth surface. In the second aspect of the present invention, this surface finishing may be carried out between steps (b) and (d) thereby retaining the scuff resistant low friction film produced by step (d) on the final surface.

In one series of tests, small ingots or "buttons" were produced by melting samples of titanium-silicon alloy as set out in Table 1 below in a water-cooled copper hearth and allowing them to cool on the hearth.

TABLE 1

| Sample No. | Composition (% by wt) |
|---|---|
| 1 | 93% Ti, 7% Si |
| 2 | 91.5% Ti, 8.5% Si |
| 3 | 88% Ti, 12% Si |
| 4 | 85% Ti, 15% Si |

Figure 1:
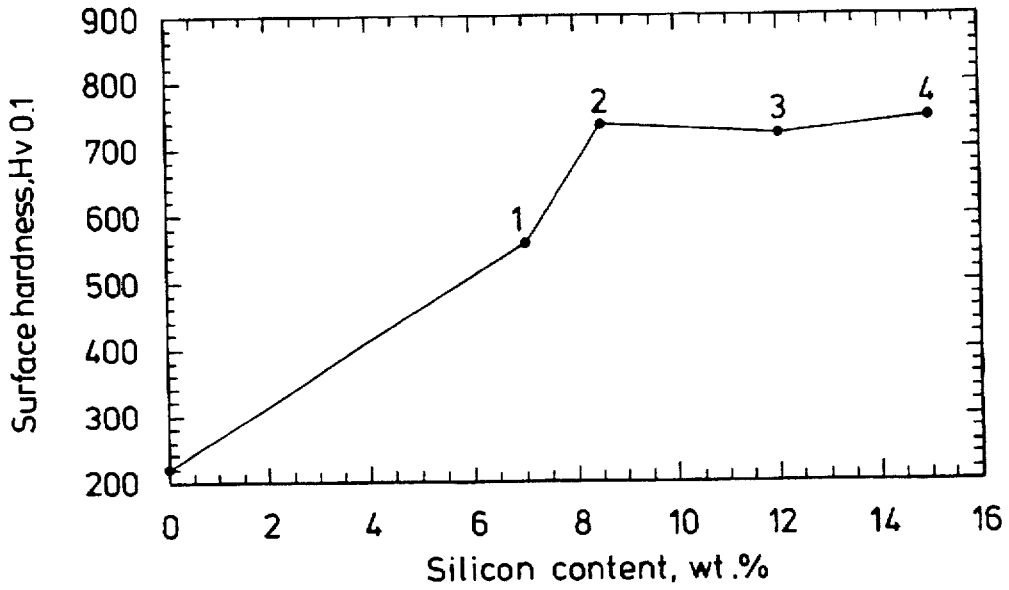
FIG. 1 is a graph indicating the surface hardness $Hv_{0.1}$ for four titanium-silicon alloy samples which have been cast and subsequently electron beam surface melted.
Figure 2:
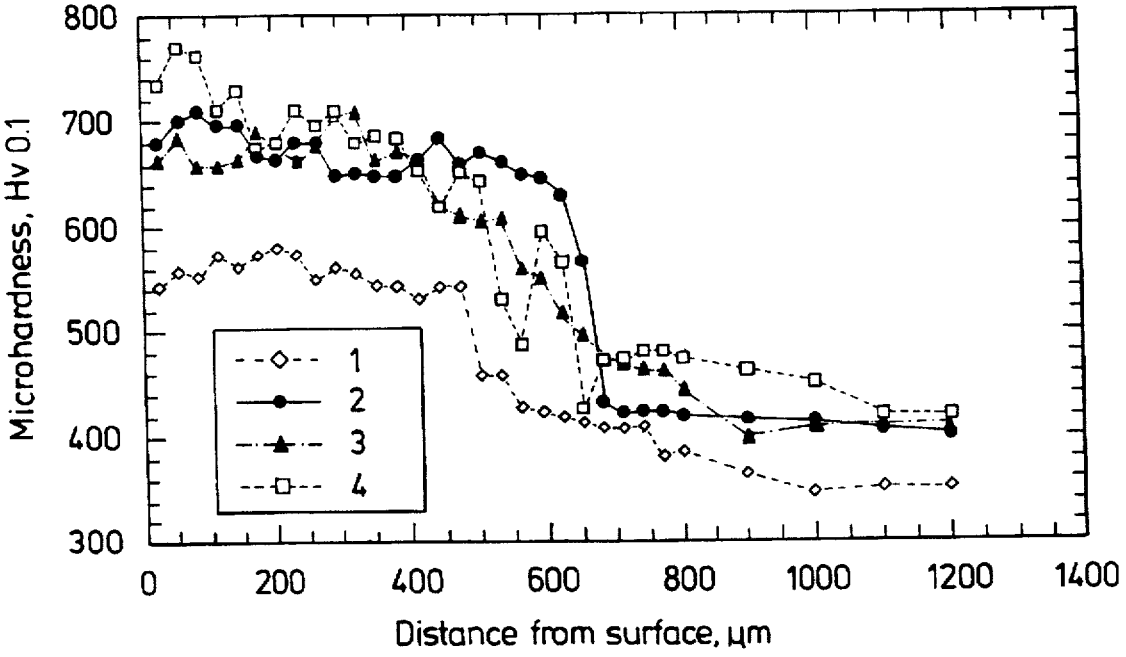
FIG. 2 is a graph plotting microhardness, $Hv_{0.1}$, against distance from the surface in respect of the four samples indicated in FIG. 1.

The as-cast Ti-Si buttons had a surface hardness of about 350 $Hv_{0.1}$ as compared with a surface hardness of about 220 $Hv_{0.1}$ for an as-cast Ti button containing no silicon. The buttons were then subjected to electron beam surface re-melting using a Zeiss electron beam welder operated at 100 kV with a current of 3 mA and a traverse rate of 16.4 mm/s. The surface hardness and the microhardness profiles of the Sample Nos. 1 to 4 are shown in FIGS. 1 and 2, respectively. It will be seen that all samples produced a useful hardness increase as compared with the as-cast buttons down to a depth of at least 500 μm, thereby effecting case hardening down to a useful depth for articles to be subjected to high contact loads.

Sample 2 produced a better hardness result than Sample 1 and its structure was a finely divided eutectic mixture of alpha plus $Ti_5Si_3$. Whilst Samples 3 and 4 had similar hardness, their structure consisted of relatively coarse dendrites of $Ti_5Si_3$ in a matrix of eutectic. The presence of brittle dendrites would be likely to lead to poorer mechanical properties, particularly fatigue properties and hence the composition of Sample 2 is preferred to that of Sample 3 or Sample 4.

From experimental work undertaken to date, the indications are that useful increases in hardness can be achieved by use of titanium alloys wherein the silicon content is greater than 5 wt % but not exceeding 9 wt %. The ideal is an alloy having a silicon content of 8.5 wt % since this represents the eutectic composition. However, compositions up to 9 wt % of silicon, i.e. slightly hypereutectic, are considered to be useful in that the production of relatively coarse hard dendrites of primary $Ti_5Si_3$ can be kept to within manageable proportions as far as the fracture behaviour of the final product is concerned.

Figure 3:
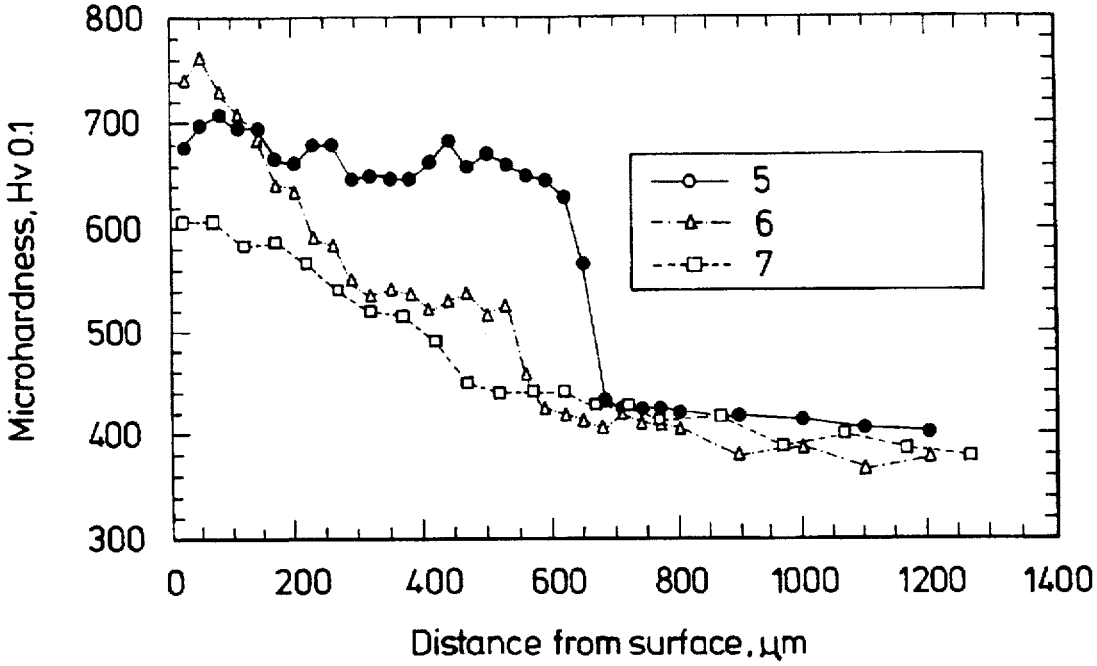
FIG. 3 is a graph similar to FIG. 2 for a Ti-8.5%Si alloy subjected to electron beam surface melting at three traverse rates.

In another series of tests to demonstrate the present invention, Sample Nos. 5 to 7 were prepared and subjected to microhardness profile testing. The results are illustrated in accompanying FIG. 3. Sample No. 5 corresponds to a Ti-8.5%Si alloy which has been subjected to electron beam surface hardening without any alloy additions using a traverse rate of 16.4 mm/s. Sample Nos. 6 and 7 correspond to samples of the same alloy as used in Sample No. 5, but where the electron beam has been traversed at a rate of 13.1 mm/s and 7.14 mm/s, respectively. The depth of molten pool is similar in the three cases, but the extent of hardening can be varied by altering the traverse rate. The greatest hardening was achieved with the highest rate of traverse because it is believed) of the consequent more rapid quenching of the molten metal.

As a further example of the first aspect of the present invention, samples of Ti-Ni alloy buttons were prepared having the following compositions (by weight):

| Sample No. | Composition (% by weight) |
|---|---|
| 8 | Ti-7% Ni |
| 9 | Ti-10% Ni |
| 10 | Ti-28.5% Ni |

Figure 4:
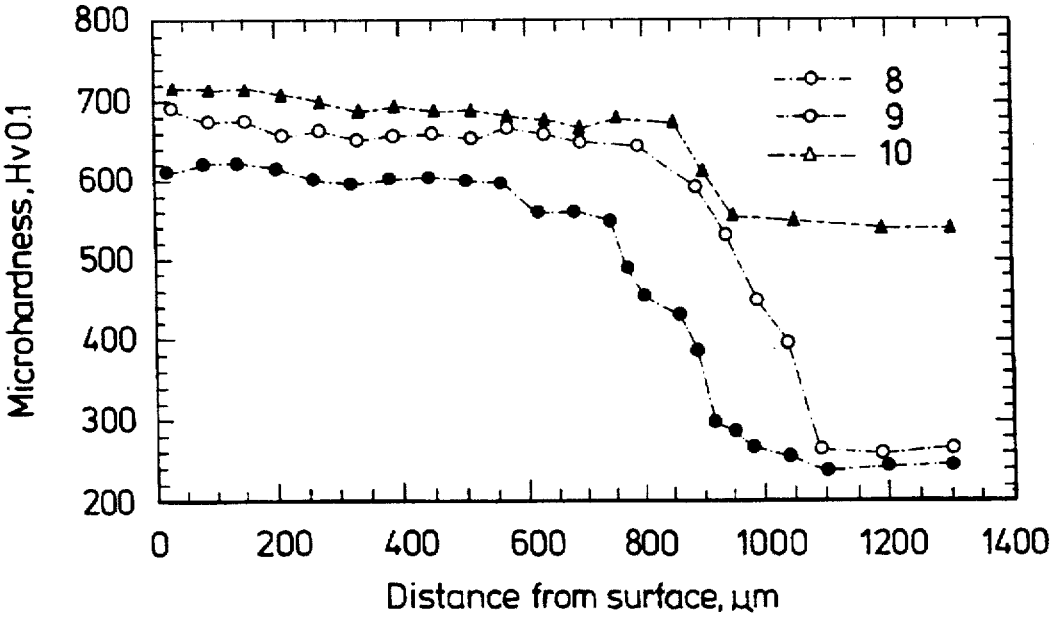
FIG. 4 is a graph similar to FIG. 2 for three titanium-nickel alloy samples.

The surface of each button was ground flat and then surface re-melted by electron beam using the same conditions as for Samples 1 to 4. The hardness profiles through the re-melted surface of these samples are shown in FIG. 4.

Sample No. 9 is the known hypoeutectic composition and the re-melted surface metal had a fine α structure and a hardness in excess of 650 Hv. Beneath the remelted layer, the substrate structure was much coarser because of its lower rate of cooling and had a hardness of only about 240 Hv. Sample No. 8 had a lower nickel content and the smaller volume fraction of the $Ti+Ti_2Ni$ eutectic microstructure gave rise to a lower hardness. Sample No. 10 was a eutectic alloy having a wholly eutectic structure of intermetallic compound $Ti_2Ni$ and α-titanium. The presence of this amount of compound can be expected to result in poorer mechanical properties, particularly fatigue properties, in the same way as in the hypereutectic Ti-Si alloys. Furthermore, the high nickel content resulted in a much harder substrate of over 500 Hv which is likely to give rise to unacceptably low ductility for the core of an engineering component. The preferred composition is therefore in a range around the eutectic composition of Ti-10% Ni, typically 5 to 15% by weight nickel.

Figure 5:
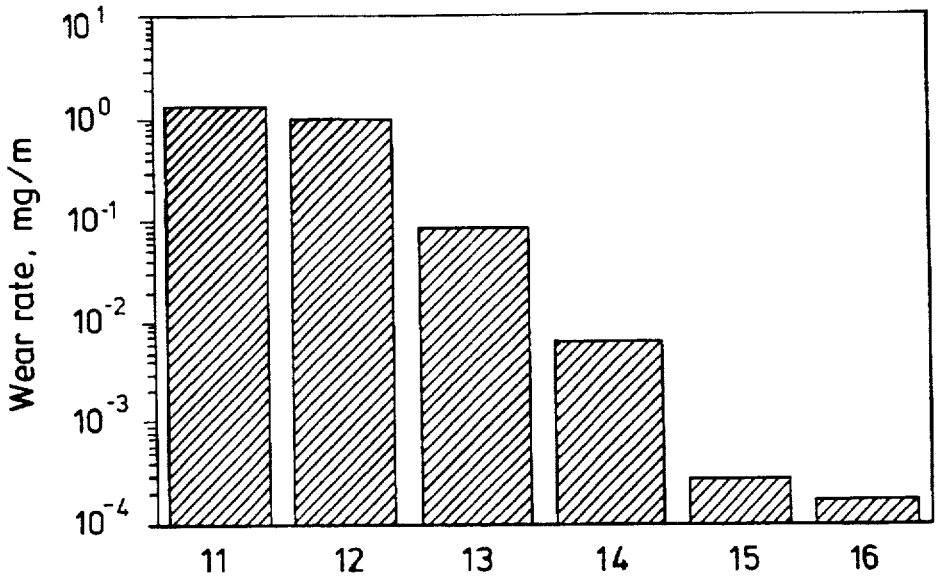
FIG. 5 is a block diagram showing the wear rate (mg/m) for various samples.

In a series of tests demonstrating the second aspect of the present invention, the lubricated sliding wear rates of five specimens were compared using a modified Amsler wear testing machine. The flat surface to be tested was held stationary beneath the rotating outer rim of a 50 mm diameter 8 mm wide disc of hardened steel rotating about a horizontal axis. A contact load of 50 kgf was applied with a sliding speed of 0.52 m/s and the wearing surfaces were lubricated by immersion in Tellus Oil 37. The resulting rates of wear of the samples are shown in FIG. 5.

Sample No. 11 was untreated annealed Ti-6Al-4V and was observed to wear extremely rapidly. Sample No. 12 was Ti-8.5%Si in the as-cast state, without any surface re-melting, and also wore extremely rapidly. Sample No. 13 was the same composition as Sample No. 12 but the surface had been re-melted by electron beam using the same conditions as for Sample No. 10, and the wear rate was reduced by a factor of more than ten. Sample No. 14 was again of the same composition, but the surface had been treated by plasma nitriding in an atmosphere of 100% nitrogen on a 40 kw plasma nitriding unit manufactured by Klockner Ionon GmbH for 12 hours at 700° C., without any surface re-melting. The rate of wear was improved by a factor of over 100 compared with the untreated alloy (Sample No. 12). Sample No. 15 had been surface treated according to the second aspect of the present invention, namely by electron beam surface re-melting without further alloying, followed by plasma nitriding in 100% nitrogen for 12 hours at 700° C. in the same way as Sample No. 14. Sample No. 16 was again of the same composition as Samples 10 to 15 and had again been surface treated according to the second aspect of the present invention, namely by electron beam surface re-melting without further alloying followed, in this instance by thermal oxidation in an air-circulation furnace for 10 hours at 650° C. It will be observed that Sample Nos. 15 and 16 were both treated in exactly the same way except that, in step d) of the second aspect of the present invention, Sample No. 15 was treated by plasma nitriding whereas Sample No. 16 was treated by thermal oxidation. The wear rates of both Samples 15 and 16 were thereby reduced to a level less than that produced by either of the two component processes on its own, and representing an improvement factor of several thousand compared with untreated material.

We claim:

1. A method of forming a titanium alloy product having a hardened layer thereon, comprising the steps of:

(1) forming an intermediate product from a titanium alloy consisting of (a) 8 to 11% by weight nickel, (b) 0 to 7% by weight of at least one strengthening alloying element selected from the group consisting of aluminum, tin, zirconium, vanadium, chromium, iron, molybdenum and niobium, and (c) 0 to 2% by weight of at least one alloying element which is a surface-property improver and which is selected from the group consisting of boron, carbon, nitrogen, oxygen and zirconium, the balance apart from impurities being titanium, and (2) surface treating the intermediate product by a surface melting and rapid solidification operation so as to produce a titanium alloy product having a hard wear-resistant surface layer without substantially affecting the bulk properties of the alloy.

2. A titanium alloy product formed of a titanium alloy consisting of (a) 8 to 11% by weight nickel, (b) 0 to 7% by weight of at least one strengthening alloying element selected from the group consisting of aluminum, tin, zirconium, vanadium, chromium, manganese, iron, molybdenum and niobium, and (c) 0 to 2% by weight of at least one surface property-improving element selected from the group consisting of boron, carbon, nitrogen, oxygen and zirconium, the balance apart from impurities and incidental ingredients being titanium, the titanium in the bulk of the product being present predominantly in the α phase, and said product having a layer thereon containing fine grained Ti-Ni eutectic.

3. A method of forming a titanium alloy product which is resistant both to rolling contact fatigue and to scuffing, comprising the steps of:

(a) forming a titanium alloy to the required product shape, (b) deep surface hardening the resultant shaped product to a depth greater than 100 μm by a technique involving localized surface re-melting without further alloying, so as to form a deep-hardened layer, (c) subsequent to step (b), optionally surface finishing to the required final shape and/or surface finish, and (d) subsequently forming on said deep-hardened layer a surface film having a thickness which is not greater than 100 μm and which is resistant to scuffing, said surface film being selected from the group consisting of nitride, oxide, carbide and boride.

4. A method as claimed in claim 3, wherein said titanium alloy consists of (a) 2 to 15% by weight silicon or 5 to 15% by weight nickel, (b) 0 to 7% by weight of at least one strengthening alloying element selected from the group consisting of aluminum, tin, zirconium, vanadium, chromium, iron, molybdenum and niobium, and (c) 0 to 2% by weight of at least one alloying element which is a surface-property improver and which is selected from the group consisting of boron, carbon, nitrogen, oxygen and zirconium, the balance apart from impurities and incidental ingredients being titanium, and wherein the deep surface hardening step (b) is conducted by localized surface re-melting.

5. A method as claimed in claim 3, wherein the thickness of said deep-hardened layer is 200 to 1000 μm.

6. A method as claimed in claim 3, wherein the thickness of said surface film is no more than 50 μm.

7. A method as claimed in claim 6, wherein the thickness of the surface film is 1 to 20 μm.

8. A method as claimed in claim 3, wherein the forming step (d) comprises a plasma nitriding step in which the titanium alloy is reacted with nitrogen in a low discharge plasma in order to form layers of nitride and nitrogen-rich titanium on the surface of the titanium alloy.

9. A method as claimed in claim 3, wherein the forming step (d) comprises a thermal oxidation step in which the titanium alloy is heated in air at 600° to 850° C. to produce layers of oxide and oxygen-rich titanium on the surface of the titanium alloy.

10. A method as claimed in claim 3, wherein said surface finishing step (c) is carried out.

11. A method as claimed in claim 10, wherein the surface finishing step (c) comprises machining or grinding to produce a smooth surface.

12. A method as claimed in claim 3, further including (e) the step of performing a procedure after any of steps (b), (c) and (d) to modify the residual stresses in the material and/or its other mechanical properties.

13. A method as claimed in claim 12, wherein step (e) is a shot peening or heat-treating step.

14. A method as claimed in claim 3, wherein the titanium alloy contains nickel in an amount of 8 to 11% by weight.

* * * * *